United States Patent [19]

Edwards et al.

[11] Patent Number: 4,901,461

[45] Date of Patent: Feb. 20, 1990

[54] HOUSE IDENTIFICATION FIXTURE

[75] Inventors: Raymond A. Edwards; Kevin S. Edwards, both of Tuxedo Park, N.Y.

[73] Assignee: Light-House Products, Inc., Tuxedo Park, N.Y.

[21] Appl. No.: 142,513

[22] Filed: Jan. 11, 1988

Related U.S. Application Data

[63] Continuation-in-part of Ser. No. 779,809, Sep. 25, 1985.

[51] Int. Cl.[4] ..... G09F 13/04

[52] U.S. Cl. ..... 40/575; 40/564; 40/553; 40/463; 40/902; 340/701; 340/815.01; 340/815.04; 340/815.15; 362/145; 362/276

[58] Field of Search ..... 40/476, 564, 576, 541, 40/553, 570, 575, 578, 463–465, 593, 902; 362/812, 457, 145, 243, 247, 276, 296, 375; 340/700, 701, 815.01, 815.15, 870.17, 870.16, 815.04, 815.03; 52/DIG. 13; 116/173; 374/132, 100, 109, 120, 208, 209

[56] References Cited

U.S. PATENT DOCUMENTS

| | | | |
|---|---|---|---|
| 1,871,650 | 8/1932 | Bartley | 40/476 |
| 2,631,394 | 3/1953 | Sopocko | 40/564 |
| 2,818,668 | 1/1958 | Bruner | 40/553 |
| 3,015,900 | 1/1962 | Frink et al. | 40/564 |
| 3,041,600 | 6/1962 | Gumpertz et al. | 340/815.04 |
| 3,103,657 | 9/1963 | Clark | 340/815.04 |
| 3,104,484 | 9/1963 | Wood | 40/463 |
| 3,149,841 | 9/1964 | Hullman | 340/815.04 |
| 3,348,415 | 10/1967 | Ash, Jr. | 374/208 |
| 3,389,389 | 6/1968 | Minear | 40/463 |
| 3,414,999 | 12/1968 | Mason | 40/576 |
| 3,611,603 | 10/1971 | Gesner, III | 40/564 |
| 3,651,512 | 3/1972 | Summers | 40/573 |
| 3,666,936 | 5/1972 | Webster, Jr. et al. | 40/564 |
| 3,680,238 | 8/1972 | Arnold | 40/564 |
| 3,761,913 | 9/1973 | Williams | 40/463 |
| 3,789,211 | 1/1974 | Kramer | 40/902 |
| 3,805,049 | 4/1974 | Frank et al. | 40/902 |
| 3,898,884 | 8/1975 | Hopkins et al. | 374/109 |
| 3,916,404 | 10/1975 | Gouge | 40/570 |
| 3,946,613 | 3/1976 | Silver | 374/208 |
| 4,068,428 | 1/1978 | Peterson, III | 52/DIG. 13 |
| 4,079,555 | 3/1978 | Barnes | 116/173 |
| 4,264,979 | 4/1981 | Gutowski | 40/593 |
| 4,333,092 | 6/1982 | Field | 340/815.04 |
| 4,455,096 | 6/1984 | Brandstedt | 340/870.17 |
| 4,466,208 | 8/1984 | Logan, Jr. et al. | 40/570 |
| 4,587,597 | 5/1986 | Meyers | 40/553 |
| 4,611,265 | 9/1986 | Davis | 40/552 |

*Primary Examiner*—Kenneth J. Dorner
*Assistant Examiner*—J. Hakomaki
*Attorney, Agent, or Firm*—Laff, Whitesel, Conte & Saret

[57] ABSTRACT

A system for identifying a house includes a display unit mounted outside the house, the display unit housing a plurality of bulbs for back lighting a translucent panel, with numbers affixed thereto. A combined control module/power pack within the house and in electrical communication with the display unit. The power pack includes an electronic control circuit for selectively providing a plurality of modes of operation, including an automatic operation (e.g. the display unit goes on at dusk and off at dawn), manual operation, blinking white display, and blinking red display, plus an override in any mode, including an off mode. The blinking display signals an emergency condition. A separate status display enables a home owner to give a status signal to a person outside the house to give warning of such thing as the presence of a home invader, for example.

12 Claims, 2 Drawing Sheets

HOUSE IDENTIFICATION FIXTURE

This is a continuation-in-part of U.S. patent application No. 06/779,809, filed Sept. 25, 1985.

Field of the Invention

This invention relates to illumination devices, and more particularly to devices for illuminating a house identifier, number, or other information or messages, and to facilitate observation of them from the street.

BACKGROUND OF THE INVENTION

Identifying houses by their street number or other identification has been a longstanding problem. House numbers and the like are generally attached on, above, or in the vicinity of the front door of a house. Very often, however, house numbers are difficult to see from a distance or from a passing vehicle. The number may be hidden, missing, or broken. Moreover, at night, even a prominent house identification number, when not illuminated, is difficult or impossible to see. In addition, emergency service persons such as ambulance drivers or policemen often lose precious minutes in identifying the proper home during an emergency.

The above problems are accentuated in suburban areas where houses are commonly set back from the street and sidewalk, having front yards and lawns. In addition, the serene exterior of a house may belie danger or burglary occurring therein, with no means for giving an exterior visual alert.

Thus, there is a need for a system which gives a home owner many optional displays which enable him to match the display with the urgency and the nature of the event prompting the display.

SUMMARY OF THE INVENTION

The invention addresses the problem of house identification by providing a novel, multi-mode of control illuminated house numbering fixture. The identification fixture is visible from a distance both day and night, fulfilling the above-noted need to identify one's home. It enables local emergency organizations to find the home and provide the needed help without delay.

An efficient and economical device, the invention has a capacity for multi-modal operation including manual control, automatic control, override, blinking white, and blinking red modes. The present invention provides an ease of installation and bulb replacement, a capacity for external actuation (e.g. smoke alarm), and bulb and battery back-up and testing systems. In addition, it is contemplated that the present device include the capacity for communicating messages to a viewer.

As can be seen, the house identification device disclosed herein overcomes a longstanding problem providing a versatile and efficient identification system.

The modular design of the invention provides for a high level of installation flexibility which enables a substantial modification of the product to fit user needs, without requiring reflectors. The modular construction lends itself to computerized control and use with alternative power sources. For example, in an emergency, such as during a power failure, the inventive device may be plugged into an auto battery. The invention can be post-mounted or secured directly to a building. No reflectors are needed to amplify the light sources, even if some bulbs fail.

DETAILED DESCRIPTION OF THE PREFERRED EMBODIMENTS

Figure 1:
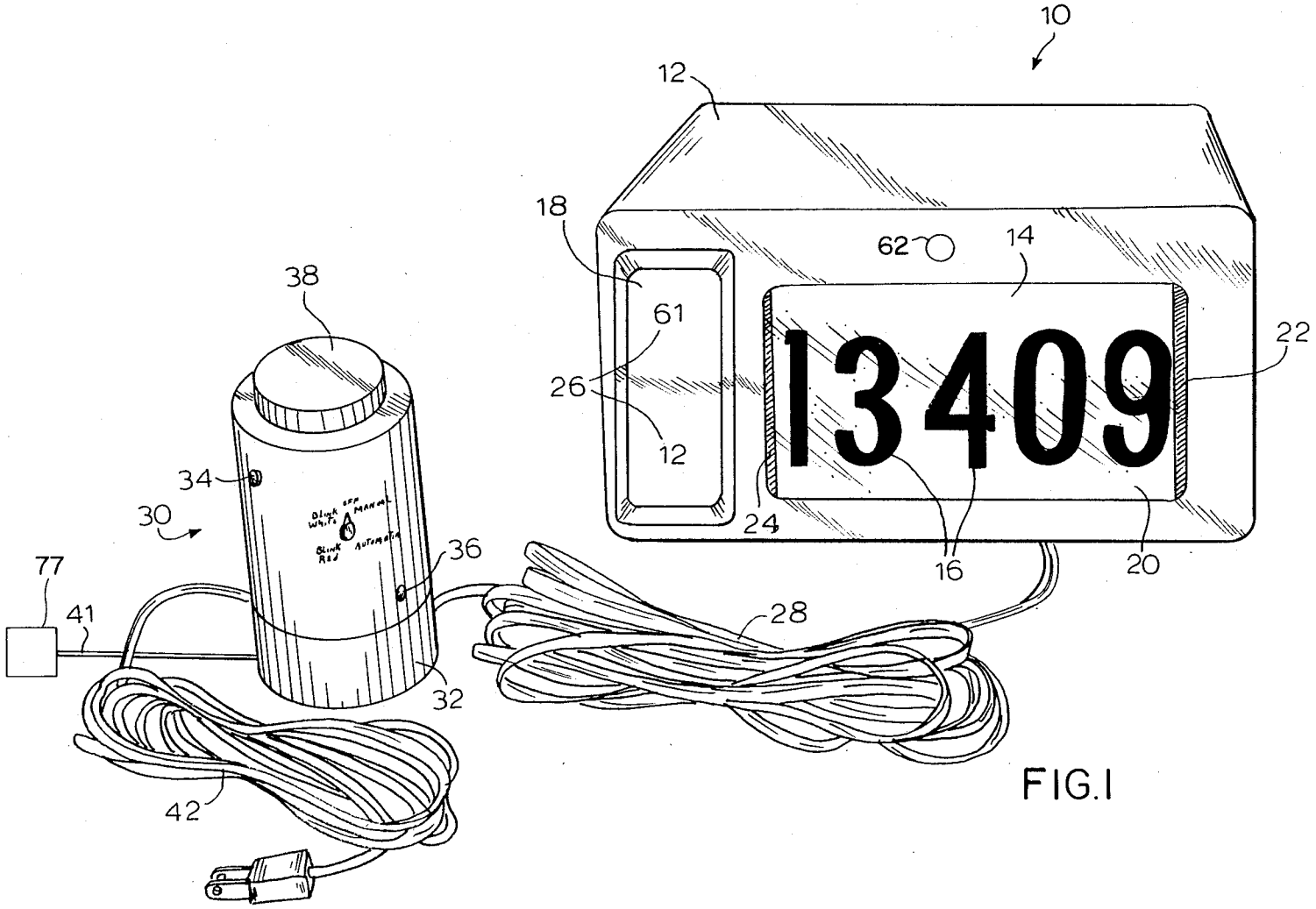
FIG. 1 illustrates a perspective view of the present invention including the transformer and the display apparatus.

FIG. 1 provides a perspective view of the present invention. Two embodiments of the present invention are contemplated, a device having automatic features and a device without those features. The automatic embodiment conforms to FIG. 1, while the manual device is substantially identical, but does not have certain of the control features The automatic device as compared to the manual device is further discussed below.

Display unit 10 includes a housing 12, a window 14, identification numbers 16, and message window 18. Housing 12 is preferably approximately 7 inches high, 11.5 inches wide and 3 inches deep. Numbers 16 are mounted on a white translucent light panel 20 which is preferably attached to housing 12 by "Velcro" brand hook and loop fastener strips 22 and 24, for example. The "Velcro" strips hold the translucent light panel 20 on housing 12 while providing for ease of removal and replacement of bulbs. A preferred embodiment of this invention is capable of displaying any suitable indicia, such as six numbers and a hyphen or a letter, or no numbers, just a name, or any other suitable symbols. An optional message window 26 may provide an outdoor message, if desired, for an arriving emergency service person, e.g. to warn a policeman that a burglar has a gun. This message may be encoded, if desired, as illustrated by code symbols.

Preferably, the entire housing is made of a white translucent ABS plastic to give the light emanating from it and the entire unit an aura. For example, with the approximate dimensions listed above, a housing constructed of white translucent ABS plastic will extend the illumination beyond the housing walls to about a distance of 2 feet on all sides, producing an illuminated area of approximately 16 square feet around the housing. This same housing, in combination with low voltage, permits high illumination without excessive heat build up, the use of light reflectors, or high voltage bulbs. This will increase the probability that the unit and its displayed house number or other information is quickly and distantly sighted.

Figure 2:
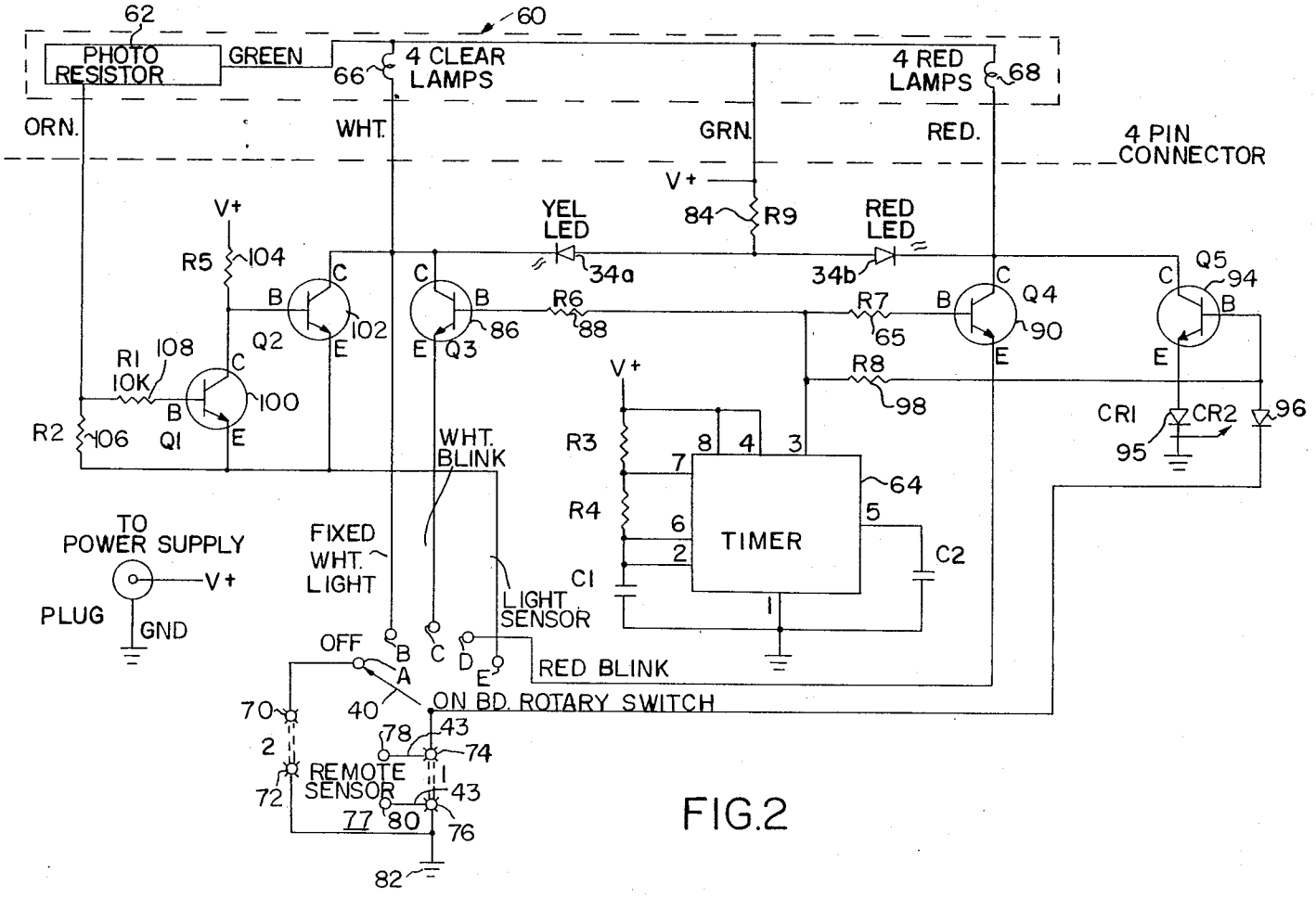
FIG. 2 is a schematic diagram of a circuit for controlling the lighting of the display apparatus.

Electrical cord 28 extends from display unit 10 to combined control module and power pack 30. Cord 28 is generally run from the outdoor unit 10 into the house for enabling a convenient remote control of the display unit. Cord 28 attaches to transformer and power pack section 32 of control module and power pack 30. The power pack may include multiple indicator light 34 to signal the homeowner when the display unit is switched on and in operation. A fuse 36 may also be provided. A cover 38 may be easily removed to facilitate installation and maintenance of the electrical connection and circuitry. Section 41 includes a control module which is shown in FIG. 2

A multiposition control switch 40 controls the display unit and includes settings for an off/on position, manual operation, automatic operation, blinking red, and blinking white displays. In the automatic operation position the display unit automatically turns itself on and off, as at dusk and dawn, for example. The manual switch position bypasses and overrides the automatic controller so that the user can operate the display device at will. When the control switch 40 is in the blink white position the light panel 20 is caused to blink with normal white light, enabling an identification of the home. White light blinking would most often be used if a friend, repairman, delivery man, or the like is expected. In the blink red position light panel 20 is caused to blink with a red light. It is contemplated that the blink red switch will be used to identify the home to an ambulance operator, policeman or the like. An optional audible alarm may also be installed to function when this position is selected.

The display unit may also be controlled by a remote sensor 77, such as a smoke alarm, for example, via a cord 43. Other remote sensors may be a burglar alarm or a cold temperature sensor signal, which are operable even if the display unit is in an off position.

Power pack 30 has a cord 42, with a plug 44, extending from transformer portion 32 to a 110 volt AC wall socket. A battery back up system may also be provided in conjunction with control module/power pack 30. A non-flutter circuit is provided to assure operational quality of the display unit. Duplicate bulbs are included in each circuit to ensure that if one bulb fails the others will still provide enough illumination to make the house number readable. When control switch 40 is in the blink red or blink white positions, indicator light 34 also blinks unless both of the duplicate bulbs are burned out, in which case indicator light 34 may remain unlit.

The display unit 10 is generally located on the exterior of a house. It may be quickly attached to an outside wall of a dwelling by using two or four screws which penetrate the back of the light panel cavity. Access to these holes is accomplished by gently bending inwardly the translucent light panel 20 with the eraser end of a pencil and pulling outward. The light panel cover should pop out with a minimum of effort. The cord 28 from the power pack to housing 12 is preferably the same kind of wire that is used as a telephone extension cord. Display unit 10 may also be placed in the interior window of a house if desired.

FIG. 2 shows the circuit which controls the lighting of the display and which is preferably housed within the control module/power pack 30 (FIG. 1). The principal elements of FIG. 2 are a lamp field 60, a light sensing photo resistor 62, a timer 64, and a number of transistors. As here shown, there are four clear 66 and four red 68 lamps which are distributed across the width of and behind the translucent panel 20. It is contemplated that any two lamps of each color are sufficient to display the indicia. Therefore, half of the bulbs could burn out before the display becomes difficult to read from street distances greater than 100 feet.

The timer 64 may be any suitable device. One embodiment used a standard CMOS integrated circuit timer 555 manufactured by the Sprague Electric Company of New Hampshire. This timer 64 may be adapted to switch the lamp bulbs 60 either off and on or between bright and dim levels of illumination. The advantage of a bright-dim operation is that the filaments have a lifetime which is longer than it would be if the lamps are switched on and off. The disadvantage of bright-dim operation is that it may be less attention getting than on/off operation.

The switch 40 (FIG. 2) may be manually moved to any one of five different steps or positions A–E. On switch step or position A, the circuit is switched off. However, an option is provided by which a remote sensor may control the emergency lighting of the lamps even while the switch is in any position, including off. In greater detail, a wire is normally connected across terminals 70, 72 and another wire is connected across terminals 74, 76. If it is desirable, any suitable remote sensor 77 (such as a smoke detector, for example) may be connected across terminals 78, 80, in which case the wire is removed at 74, 76. This remote sensor should have normally closed contacts, in simulation of the wire connected via wire 43 across terminals 74, 76, which contacts are opened when the sensed condition occurs. If the wire across terminals 70, 72 is also removed, the remote sensor may override the "off" switch step or position A and turn on the light. If the wire is left in place at terminals 70, 72, there is no effect if the remote sensor opens its contacts while switch 40 is on step A.

On switch step B, ground 82 is applied over a wire directly to the filament of the clear bulbs 66 to give a steady white light. This same ground is applied to a cathode of a yellow LED **34*a* to give a visual signal at 34 in FIG. 1. The anode of LED 34*a* is connected through a bias resistor 84**, to battery V+.

On step C, switch 40 applies ground 82 to the emitter and through transistor 86, LED **34*a*, and bias resistor 84 to battery V+. The timer 64 cyclically applies an "on" bias through a coupling resistor 88 to the base of transistor 86. Depending upon the timer, this bias voltage switches the transistor 86 either on and off to blink the lights or between high and low to give a bright-dim lamp operation. The lamp current is over the path from ground 82, through switch 40 on step C, transistor 86, and clear lamps 66 to V+ battery. The LED 34*a* blinks as transistor 86** switches on/off (or high/low).

On step D, switch 40 applies ground 82 to the emitter of a transistor 90 which operates exactly the same as transistor 86 operates under the influence of timer 64 and via coupling resistor 65. This time the red lamps 68 are lit over the path from ground 82, through switch 40 on step D, transistor 90, and the filaments of red lamps 68 to battery V+. The red LED **34*b* flashes as the timer 64 switches transistor 90** on/off (high/low).

Transistor 94 is controlled by the remote sensor 77. The emitter of transistor 94 is biased to ground via diode 95, the collector to battery V+ via LED **34*b* and resistor 84. Normally ground 82 is always applied to diode 96 either through a wire connected across terminals 74, 76 or through normally closed contacts in sensor 77. This ground 82 always clamps the base of transistor 94 in an off condition. If the remote sensor 77 reacts to an emergency condition (smoke is detected, for example), the contacts across terminals 78, 80 are opened. The clamping ground 82 is removed from the cathode of diode 96. The timer 64 switches on/off (high/low) in response to bias applied to transistor 94 via resistor 98. The red lamps 68 light over the path from ground at diode 95 through transistor 94 and, lamps 68 to battery V+. The LED 34*b* also lights through resistor 84** to battery V+.

If the wire should have been left intact across terminals 70, 72, the remote sensor's opening and closing of a switch across terminals 78, 80 would have no effect when switch 40 is on step A or the "off" position or any other position.

On step E, the display is automatically lit when the ambient light drops below a threshold value, as at dusk, for example. In greater detail, ground 82 is applied over switch 40 on step E, to the emitters of transistors 100, 102. The collector of driver transistor 100 is supplied from battery V+ via load resistor 104. The collector of transistor 102 is supplied from battery V+ via the load of clear light bulbs 66, and via resistor 84 and LED 34*a*. The collector of driver 100 is connected to the base of transistor 102.

The potential on the base of transistor 100 is controlled from photoresistor 62. When photoresistor 62 is in the presence of light, the voltage applied from battery V+ through the photoresistor 62 and coupling resistor 108 clamps transistor 100 in an off condition and transistor 100 remains off. When the ambient light falls below a given level, the resistance of photoresistor 62 increases as photoactivity in the resistor decreases. The bias voltage applied through resistors 106, 108 to the base of the transistor 100 changes to switch it on.

As transistor 100 becomes conductive, the ground 82 is applied over switch 40 on step E and through transistor 100 to the base of transistor 102 which then switches on. The clear lamps 66 are now lit over a path from ground 82 through switch 40, step E, transistor 102, and lamps 66 to battery V+. The lamps 66 go dark when the resistor 62 is again exposed to light so that the base bias on transistor 100 changes to switch it off.

Some of the advantages of the invention should now be clear. More particularly, the solid state circuit (FIG. 2) is unique to this field of home products. Most low voltage circuits in homes (such as doorbells and furnace controls, for example) use 16 V AC circuits. When the 110 V or 16 V AC circuits are pulsed by the crude interrupters used in this field, they produce significant radio frequency levels which would likely be heard on home radios. Also, the use of DC enables the circuit of FIG. 2 to operate from noise-free, easily rechargeable battery backup power supplies. These DC circuits enable an easy inclusion of the inventive system into a message center's microcomputer. Finally, the "blink rate" is easily changed by changing values in a resistor-capacitor circuit.

While a detailed description of the invention is provided, it is to be understood that the scope of the invention is not to be limited thereby, but is to be determined by the scope of the claims which follow.

What is claimed is:

1. An apparatus for identifying a house comprising:

a display unit having a low voltage light source there within, and having an identification symbol on the display unit and illuminated by the light source, the display unit comprising a rectangular housing with no reflector and having a window on a front face, the light source comprising a plurality of light bulbs within the housing, there being enough light bulbs to provide reliable illumination without a reflector after some bulbs fail, and a translucent panel mounted in the window having the identification affixed thereon;

a power pack in electrical communication with the display unit, the power pack including a source of low voltage and a multi-modal electronic control circuit for operating the display unit in at least three separate modes including an emergency and a non-emergency mode;

the controls provided by the power pack comprising a remote sensor control for illuminating the display unit independently of said multi-modal control including illumination when the apparatus is switched off; and an electrical, commercial power source in electrical communication with the power pack for energizing the source of low voltage.

2. The apparatus according to claim 1 and an ambient light sensor and wherein the controls provided by the power pack further comprise a control means for automatically illuminating the display unit in response to a signal from said ambient light sensor.

3. The apparatus according to claim 1 wherein the electronic control circuit further comprises control means for illuminating the display unit with at least one blinking light during said emergency mode, said one light continuing to blink until it is manually shut off.

4. The apparatus according to claim 3 wherein the front face of the housing with no reflector and further comprises a panel for displaying status messages.

5. The apparatus according to claim 4 wherein the translucent panel is affixed to the window by hook and loop fastener means at either end for enabling bulb installation and replacement.

6. The apparatus according to claim 5 wherein the power pack further comprises a DC back up power source.

7. The apparatus according to claim 6 wherein the power pack contains an indicator light to indicate whether the display unit is illuminated.

8. An apparatus for identifying a house comprising:

a display unit having a housing which encloses a plurality of redundant low voltage light bulbs, wherein at least two of the light bulbs have different colors, a window in at least a front face thereof, a translucent panel having house identification numbers and being mounted in the window and releasably secured thereto;

a first electrical cord affixed at one end to the display unit;

a power pack affixed to the other end of the electrical cord whereby the power pack may be located at a remote control position which is away from said display unit, the power pack comprising a transformer, a manually controlled electronic control circuit means for changing modes of operation of the display unit; said control means being adjustable to an off position, a manual operation position, an automatic operation position, a position for flashing a bulb having one of said colors; and another position for flashing a bulb having another of said colors, said power pack further comprising a fuse and an indicator light for indicating that the display unit is operating; said electronic control circuit means being set in accordance with the setting of the manual control means for selectively illuminating said bulbs in any of a plurality of modes; and means effective even when said apparatus is switched off for receiving a signal from a remote sensor for automatically illuminating the display device under certain alarm conditions, said light remaining illuminated until it is manually reset; and a second electrical cord associated with said power pack for plugging into an electrical power source.

9. The apparatus of claim 8 wherein said electronic control means comprises a timer means for flashing said lights in at least one of said modes.

10. The apparatus of claim 9 wherein the timer means includes means for causing said flashing at a rate which avoids radio interference.

11. A display apparatus comprising a housing having at least one light translucent panel with indicia thereon and being positioned for viewing from outside said housing, illuminating means for back lighting said panel in one of at least two colors, remote control means, means responsive to said remote control means for manually selecting at least one of said two colors for illuminating said panel at any given time, means responsive to said remote control means for selectively lighting the selected color in a selected one of a plurality of modes of illumination, said means for lighting in one of said modes comprising transistors individually associated with each of said colors for applying an energizing potential to said illuminating means, timing means for flashing said selected color in one of said modes, said timer means cyclically driving said transistors in order to provide said illumination at two alternating levels of flashing illumination, and remote sensor means for preempting said illuminating means in response to a sensed condition including illumination when the apparatus is switched off.

12. The display of claim 11 wherein said means for lighting in said two modes comprises transistors individually associated with each of said colors for applying an energizing potential to said illuminating means, said timer means for cyclically driving said transistors in order to provide said illumination at two alternating levels of illumination to provide said flashing.

* * * * *